US006630891B1

(12) United States Patent
Dilling

(10) Patent No.: US 6,630,891 B1
(45) Date of Patent: Oct. 7, 2003

(54) VEHICLE WARNING SYSTEM

(76) Inventor: Emery W. Dilling, 6800 Austin Center Blvd., Number 761, Austin, TX (US) 78731

( * ) Notice: Subject to any disclaimer, the term of this patent is extended or adjusted under 35 U.S.C. 154(b) by 0 days.

(21) Appl. No.: 10/156,509

(22) Filed: May 27, 2002

(51) Int. Cl.[7] ..... G08G 1/00

(52) U.S. Cl. ..... 340/902; 340/901; 340/903

(58) Field of Search ..... 340/902, 901, 340/903, 904, 906, 988, 989, 436, 691.1, 691.3, 691.5, 435, 467, 447, 457.4; 701/301, 29

(56) References Cited

U.S. PATENT DOCUMENTS

| | | | | | |
|---|---|---|---|---|---|
| 3,760,349 | A | * | 9/1973 | Keister et al. | 340/902 |
| 4,761,796 | A | | 8/1988 | Dunn et al. | |
| 4,818,998 | A | | 4/1989 | Apsell et al. | |
| 4,903,279 | A | | 2/1990 | Murakami et al. | |
| 4,908,629 | A | | 3/1990 | Apsell et al. | |
| 4,952,931 | A | * | 8/1990 | Serageldin et al. | 340/902 |
| 5,022,046 | A | | 6/1991 | Morrow, Jr. | |
| 5,235,329 | A | | 8/1993 | Jackson | |
| 5,363,108 | A | | 11/1994 | Fullerton | |
| 5,448,599 | A | | 9/1995 | Gunmar | |
| 5,495,243 | A | | 2/1996 | McKenna | |
| 5,801,646 | A | * | 9/1998 | Pena | 340/902 |
| 5,889,475 | A | | 3/1999 | Klosinski et al. | |
| 5,920,194 | A | | 7/1999 | Lewis et al. | |
| 5,963,148 | A | | 10/1999 | Sekine et al. | |
| 6,014,601 | A | * | 1/2000 | Gustafson | 701/45 |
| 6,160,493 | A | | 12/2000 | Smith | |
| 6,181,996 | B1 | | 1/2001 | Chou et al. | |
| 6,191,708 | B1 | | 2/2001 | Davidson | |
| 6,240,099 | B1 | | 5/2001 | Lim et al. | |
| 6,281,806 | B1 | | 8/2001 | Smith et al. | |
| 6,288,682 | B1 | | 9/2001 | Thiel et al. | |
| 6,292,724 | B1 | | 9/2001 | Apsell et al. | |
| 6,301,311 | B1 | | 10/2001 | Sheba | |
| 6,313,794 | B1 | | 11/2001 | Rose | |
| 6,313,795 | B1 | | 11/2001 | Herrmann et al. | |
| 6,320,514 | B1 | | 11/2001 | Flick | |
| 6,320,535 | B1 | | 11/2001 | Hillman et al. | |
| 6,323,566 | B1 | | 11/2001 | Meier | |
| 6,323,802 | B1 | | 11/2001 | Tokoro | |
| 6,326,903 | B1 | | 12/2001 | Gross et al. | |
| 6,327,257 | B1 | | 12/2001 | Khalifa | |
| 6,329,901 | B2 | | 12/2001 | Brinkmeyer et al. | |
| 6,330,452 | B1 | | 12/2001 | Fattouche et al. | |
| 6,331,825 | B1 | | 12/2001 | Ladner et al. | |
| 6,331,997 | B1 | | 12/2001 | Li | |
| 6,332,579 | B1 | | 12/2001 | Ritter | |
| 6,346,877 | B1 | | 2/2002 | Flick | |
| 6,351,246 | B1 | | 2/2002 | McCorkle | |
| 6,351,652 | B1 | | 2/2002 | Finn et al. | |
| 6,353,743 | B1 | | 3/2002 | Karmel | |

* cited by examiner

*Primary Examiner*—Anh La
(74) *Attorney, Agent, or Firm*—Dennis W. Gilstad

(57) ABSTRACT

A vehicle warning system comprises encoder-transmitters in transmitting vehicles and corresponding receiver-decoder-alert subsystems in receiving vehicles. Transmitted signals carry warning information for presentation to drivers of receiving vehicles, preferably including closing velocity and encoded identification of the transmitting vehicles. Warning information may also include estimates of the speed of the transmitting vehicle and of the apparent bearing of the transmitting vehicle relative to each respective receiving vehicle. Warning information is presented via at least two alert modalities. At least one alert modality is presented intermittently, and at least one alert modality is modified when closing velocity is negative. Drivers of receiving vehicles can use this warning information to inform their judgments on safely maneuvering their vehicles to provide needed right-of-way to approaching transmitting vehicles.

20 Claims, 8 Drawing Sheets

VEHICLE WARNING SYSTEM

BACKGROUND

Emergency vehicle (EV) operators needing to move expeditiously through congested urban traffic may nevertheless be unable to do so. Drivers of other vehicles, unaware of an EV's approach because of limited visibility, air conditioning, sound insulation and/or loud music systems, delay or halt the EV's progress by blocking its path. Historically, horns, sirens and/or lights have been used to signal an EV's approach, but such warnings are increasingly inadequate and dangerous. See, for example, the background discussions in U.S. Pat. Nos. 5,235, 329 and 5,495,243, both incorporated herein by reference.

The invention of the '243 patent relates to improving the efficacy of warning lights on emergency vehicles but requires a line-of-sight to any vehicle intended to receive the warning. The line-of-sight requirement means that warnings can be selectively applied, but the effective warning range is relatively short, particularly in urban environments. On the other hand, while the warning system described in the '329 patent does not require line-of-sight to a warned vehicle, it is relatively non-selective.

The augmented warnings described in the '329 patent are intended to assist the relatively few drivers who actually need warnings to react reasonably (as by stopping or turning away from the EV's path). But many other drivers would, in general, also receive the warnings. These other drivers, who are not in or near the EV's path, would ideally not react to these false warnings (as by moving to the right lane and stopping) because in doing so they would be likely to needlessly aggravate traffic congestion. In part because it compounds the problem of false warnings, the invention of the '329 patent tends to increase traffic congestion rather than reducing it. This drawback substantially limits the net benefits of the warnings provided by the '329 invention.

To significantly improve on the '329 invention, warning methods and apparatus would preferably be more precisely focused on the vehicles and drivers actually in or near an EV's path. Since this path is generally unpredictable, warning systems should provide critical information in (nearly) real time to selected vehicles in the vicinity of the EV. Relatively long range predictions of appropriate avoidance maneuvers would confer little benefit, since even the EV driver may be uncertain about an EV's exact intended path and speed. There may be, for example, a choice of EV destinations (e.g., one of several hospitals for emergency medical treatment), a choice of routes (e.g., alternatives to avoid congestion or road construction), or a moving objective (e.g., a suspect fleeing a police stop or an accident scene). In summary, EV avoidance maneuvers preferably rely on information concerning likely encounters with relatively nearby EV's, and that information may change abruptly.

Several systems have been proposed to address one or more of the above needs. For example, U.S. Pat. No. 6,160,493 (incorporated herein by reference) describes a radio warning system that reliably transmits warning information, possibly including global positioning system (GPS) coordinates of the transmitter's location, to any system receiver within the range of a spread-spectrum signal. Extrapolating from successive sets of these transmitter coordinates might reveal an EV's intended path relative to other drivers.

The use of GPS coordinates to specify a transmitter's location could improve the value of a warning and reduce the incidence of false warnings, but the coordinates would only be available to the minority of drivers having the equipment to interpret GPS signals. The relatively high cost of needed GPS-related equipment in both transmitting and receiving vehicles would thus tend to discourage widespread adoption of the system. And without widespread adoption, any such system would be only marginally useful. Unfortunately, this situation would not be significantly improved by eliminating the GPS features of the system (i.e., the coordinates). Most drivers receiving a warning signal without at least some information on the transmitter location would experience the false warning problems described above.

Another recently-proposed system described in U.S. Pat. No. 6,326,903 (incorporated herein by reference) includes provision for electromagnetic transmission of information on direction-of-travel from one EV to another EV and/or from an EV to (controllable) traffic signals in its path. Again, the preferred source of direction-of-travel information is a GPS, although other, less accurate systems using a common direction reference (such as a compass) are also described.

A major drawback of all similar systems is that use of a common direction reference, whether based on GPS or another external coordinate system, requires each vehicle in the system to have equipment to access the common external reference. This equipment might reduce the incidence of accidents between EV's, but its unnecessary cost and complexity would also discourage widespread adoption of the system. And drivers not having access to the common direction reference, being unable to use the system, would be likely to cause about the same degree of congestion and delay as they do now.

Another communication system providing information useful in controlling traffic congestion is described in U.S. Pat. No. 5,448,599 (incorporated herein by reference). The system of the '599 patent provides reliable spread-spectrum communication between two vehicles, with the option of including speed and distance information for one vehicle relative to another vehicle. Relative speed (proportional to Doppler shift derived from the spread-spectrum signal) could be combined with distance information to inform a driver of his distance from an EV and the speed of the EV's approach, but not the direction of approach.

The system of the '599 patent provides valuable information to a driver receiving a warning signal, but the patent describes use of either a retransmitter-receiver pair or a passive reflector-receiver pair to obtain the distance separating two vehicles. Once again, cost and complexity are increased to obtain desired warning information. Further, if passive reflectors were used instead of retransmitters, the reflected signals would be useful only for relatively short distances (about 200 meters in the example provided in the patent).

Thus, as shown by the examples above, the warning systems proposed to date are relatively complex, costly, intrusive and/or ineffective. Lower cost versions of these systems suffer some of the same disadvantages as the old sirens, lights and horns, providing late, false, distracting and/or misleading warnings to too many drivers, while offering insufficient benefits in reducing EV delays and avoiding accidents.

A better warning system is needed to provide timely alerts to drivers who are either within or approaching the likely path of an EV. Such a system should provide relatively selective warnings in nearly real-time, and it should be reliable, secure, relatively inexpensive, flexible and userfriendly enough to be widely adopted. It should also make effective use of each driver's judgment and knowledge of local traffic patterns, providing supplemental information in a plurality of compatible formats usable by drivers to avoid an EV's path.

SUMMARY OF INVENTION

The present invention comprises improved vehicle warning systems that combine certain beneficial features of earlier warning systems with novel elements that confer important advantages in cost, effectiveness and/or operational flexibility. The invention relates in part to encoder-transmitter subsystems for transmitting encoded warning signals and corresponding receiver-decoder-alert subsystems. Each encoded warning signal comprises an ID code which is a unique identifier (e.g., the vehicle identification number) for the vehicle carrying its corresponding encoder-transmitter subsystem. Encoder-transmitter subsystems are typically found in EV's but more generally found in transmitting vehicles of any type authorized by the law of the jurisdiction in which they operate. To simplify portions of the illustrative discussion herein, transmitting vehicles are referred to as EV's.

Encoded warning signals of the present invention are locally broadcast from EVs to receiving vehicles, using omnidirectional and/or electronically steerable directional transmitting antennas. These warning signals are received via omnidirectional and/or electronically steerable directional antennas on receiving vehicles. While the invention encompasses any mode of electromagnetic wave transmission employing one or more frequencies, preferred embodiments comprise spread-spectrum and/or ultra-wideband (UWB) transmitters and receivers. The following U.S. Patents relate to spread-spectrum and/or UWB technology and are incorporated herein by reference: U.S. Pat. Nos. 6,351,652; 6,351,246; 6,331,997; 6,327,257; 6,301,311; 6,240,099; 5,363,108; 5,022,046; and 4,761,796.

Receiving vehicles have receiver-decoder-alert subsystems that are preferably considered as much a part of a vehicle's safety equipment as air bags. The encoder-transmitters and receiver-decoders of respective transmitting and receiving subsystems are preferably comparable in many respects to analogous elements of modern wireless telecommunication systems such as those comprising digital cell phones and those used for local area computer networks. For example, they generally transmit at power levels of 10 watts (in many applications, power levels less than 1 watt) and their multiple-access capabilities (using, e.g., code division multiple access or CDMA) mean that warnings transmitted asynchronously from a plurality of EV's can be processed in virtually real time by systems in each receiving vehicle.

Further, transmitting and receiving subsystems in a standby mode, like modern energy-efficient cell phones, draw very little electrical power from a vehicle power supply. Because of the relatively large amounts of energy stored in vehicle batteries, such transmitting and receiving subsystems can remain in standby mode almost indefinitely, being virtually always ready for use without any requirement for action by a driver.

Thus, modern communications technologies, including the relatively low cost spread-spectrum and/or UWB transmitters and receivers commonly used in digital wireless telephones and computer networks, offer clear advantages over sirens, lights and horns in reliably reaching drivers within sound-insulated vehicles. And, due to the widespread adoption of digital telephone networks employing asynchronous packet transmission of encoded digital information, such telephone equipment is readily available and can, with little or no modification, be used for encoding, transmission, reception and decoding of warning information of the present invention in packet form.

The presentation of warning information in receiving vehicles is via alert modalities that are intentionally intrusive. Alert modalities are intended to draw the attention of a receiver vehicle driver to the emergency information, notwithstanding distractions that may be present in the vehicle. To minimize the cognitive burden on the driver, delay timer means (e.g., time-delay relays, time switches or delay lines) are also provided to temporarily disable or otherwise modify at least one warning means.

Delay timer means thus function in a manner roughly analogous to the action of a snooze-alarm, which awakens a sleeper with an alarm and then allows an optional (relatively quiet) wakeup period before subsequent activation of a more intrusive alarm. One or more of the (delayed) snooze alarms intermittently remind an awakening sleeper of the need to get out of bed, whereas one or more delayed alerts are provided in the present invention to intermittently remind a driver of important warning information related to vehicular operation.

The provision for intermittent (i.e., not continuous). driver alerts via at least a first alert modality is an additional feature of the present invention. The time periods between such intermittent alerts via at least a first alert modality are established by a delay timer that is triggered by activation of a driver alert sensor. Activation of a driver alert sensor indicates a driver's acknowledgment of a warning.

Delay of a subsequent alert after a driver alert sensor activation may be either adjustable or of predetermined duration, and is both reasonable and beneficial in augmenting safe vehicle operation. Without sacrificing a driver's situational awareness of a warning, such an alert delay reduces the time-average cognitive burden tending to distract a driver from the primary task of vehicle control. U.S. Patents having useful background information include U.S. Pat. Nos. 6,281,806 and 6,181,996, both incorporated herein by reference.

Since the warning information underlying activation of an alert modality may change quickly, the delay period after such a driver alert is acknowledged is preferably terminable on receipt of new warning information. The new information might comprise, e.g., a change in velocity of an approaching EV or reception of a warning signal bearing a different ID code.

It is also preferable to ensure that any delay period is initiated only within a predetermined time period following a driver's activation of the driver alert sensor. The possibility of a driver activating the alert sensor too early (i.e., erroneous acknowledgement in the absence of an alert), or too late (i.e., lack of acknowledgement or late acknowledgement after an alert has actually been presented to the driver) is preferably detected by a response timer. When present, the response timer measures the time period between activation of at least one alert modality by an alert system interrupter/controller and activation of the driver alert sensor.

A response timer may also furnish information useful in modifying the duration of an alert delay and/or adjusting the performance characteristics of one or more alert modalities (e.g., alarms and/or displays) to better suit an individual driver. For example, late or absent activation of a driver alert sensor following an alert may be followed by an increase in the loudness and/or changes in other characteristics of an aural warning modality. Analogously, the intensity (and/or color, distribution, repetition rate or duty cycle) of light from a visual display may in certain embodiments be made adaptive to the response timer and/or to other parameters such as an EV's movement with respect to a receiving vehicle. U.S. Patents related to alarms and displays include the earlier cited '329 patent as well as U.S. Pat. Nos. 5,963,148, 5,920,194 and 5,889,475, all incorporated herein by reference.

Movement of an EV toward or away from a receiving vehicle (reflected, for example, in the estimated closing velocity between the two vehicles) is readily estimated by using time codes embedded in the signal received from the EV or by detecting Doppler shift in that signal. When an EV is not closing with a receiving vehicle, i.e., when the EV is traveling parallel to or away from a receiving vehicle, at least a first alert modality (preferably aural) is preferably attenuated or eliminated. Simultaneously, at least one additional alert modality (preferably visual) is preferably modified to indicate that the EV is not closing with the receiving vehicle.

When a plurality of EV's simultaneously transmit warning signals to a single receiver-decoder-alert subsystem having either an omnidirectional or directional antenna, each signal is decoded, and represented to the driver, individually. This is accomplished in part in the present invention because each of the transmitted warning signals, though they arrive at the receiving antenna substantially simultaneously, can be distinguished (e.g., through one or more unique carrier frequencies or a unique CDMA multiple access code).

Additionally, since each warning signal carries a unique EV ID code (analogous, for example, to a telephone number or information contained in a subscriber identity module), all warning information associated with a particular signal can be identified to a driver as relating to a single EV. Warning information that may include, for example, the corresponding EV's speed, its orientation relative to the receiving vehicle, or the received signal strength, is associated in the receiver-decoder-alert subsystem with the respective EV's ID code. This process of association is analogous to well-known methods in the telecommunications industry for preparing electronic records that associate billing information with particular telephone numbers. Examples of such methods are described in U.S. Pat. No. 6,332,579, incorporated herein by reference.

The above association of warning information with a particular vehicle ID code may also include the estimated azimuths of directional transmitting and receiving antennas on the transmitting and receiving vehicles respectively. These azimuths can preferably be estimated through use of electronically steerable directional antennas connected to the encoder-transmitter and receiver-decoder. Each such antenna can be steered so as to scan all azimuths or a subset of azimuths under the control of an antenna director.

Directional antennas are well-known in the art and commonly comprise a rotating horn or loop, or an array of elements. Representative methods and apparatus related to directional antennas are described in U.S. Pat. Nos. 6,323,802; 6,313,795; and 6,313,794, all incorporated herein by reference. A preferred form of directional antenna that is relatively inexpensive, rugged, and electronically steerable is described in U.S. Pat. No. 6,288, 682 (Thiel et al.), incorporated herein by reference.

The antenna director for each directional antenna of the present invention acts through its respective encoder-transmitter or receiver-detector to steer the antenna. For an antenna in receiving mode, a preferred steering criterion is maximization of the received strength of each individually-identified warning signal, producing in turn an azimuth signal corresponding to the azimuth at which each individual signal strength maximum occurs. For an antenna in transmitting mode, preferred steering criteria may include, for example, substantially uniform coverage in a horizontal plane or, alternatively, a transmission pattern that includes all vehicles within signal range with which the transmitting vehicle is closing.

Each estimated azimuth corresponding to a received signal as described above is associated with the ID code of the vehicle transmitting the signal in question. In a receiving vehicle, the estimated closing velocity and azimuth signal are directed by the alert system interrupter/controller to appropriate alert modalities for presentation to a vehicle driver. Each transmitting vehicle represented in such a plurality of alert modalities may then be represented individually by, for example, a corresponding plurality of characteristic sounds, colored lights, and/or icons on a graphical display.

As described above, the means for alerting a receiving vehicle driver to whatever encoded warning may be contained in a received signal comprises at least two alert modalities corresponding to two or more of the driver's senses (e.g., sight, touch, or sound). An alert system interrupter/controller activates the alert modalities and also offers flexibility in representing warning information in alternative ways. For example, one or more characteristics of an aural alert (such as tone, pitch and/or volume) may increase with higher closing velocities. Various EV types such as fire trucks, police cars, and ambulances may be represented to a driver through distinctive icons and/or color coding on a visual display, and/or through characteristic-sounding audio alerts. Audio warnings are preferably delivered by interrupting (i.e., preempting any non-emergency use of) a vehicle's built-in sound system.

Interrupting the speakers in a vehicle sound system to alert a driver to easily-recognized warning sounds is among the most cost-effective alert modalities and would frequently be preferred if only a single alert modality were to be presented to a driver. Through interruption of a vehicle sound system, highly specific aural warnings can be conveyed. These include, for example, synthesized speech or a sound that increases in pitch, tone and/or loudness as an EV approaches. But such aural warnings can be degraded by, for example, a driver's deafness, ambient noises (as from open windows), and/or multiple simultaneous warnings from different EV's. Thus, a plurality of alert modalities, including at least one non-aural modality, is preferably presented to each driver. Different drivers may prefer to customize the types of alert modalities and/or the manner of their presentation, and the alert system interrupter/controller may facilitate such modifications.

In certain preferred embodiments, a portion of the functions of a receiver-decoder-alert subsystem are preferably handled by a programmable processor. Such a processor can digitally simulate one or more of the functions of the elements described above, such as a response timer, a delay timer, an antenna director or a Doppler shift detector. Such a programmable processor is preferably located in the alert system interrupter/controller and may thus conveniently provide specific synthesized voice warnings as an alert modality in conjunction with vehicle speakers.

DETAILED DESCRIPTION

Figure 1:
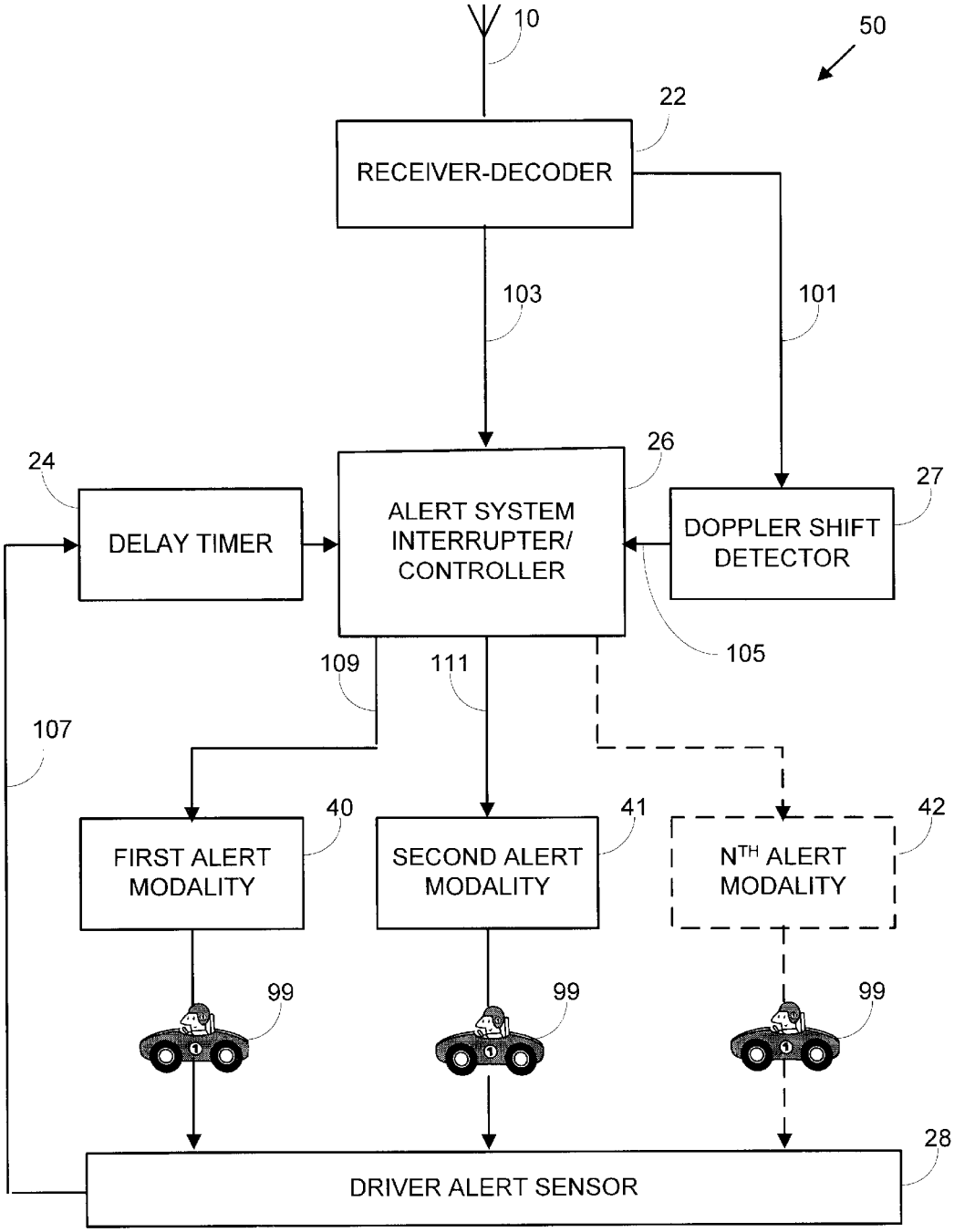
FIG. 1 schematically illustrates a preferred embodiment of a vehicle receiver-decoder-alert subsystem providing intermittent alerts comprising transmitting vehicle ID and closing velocity.
Figure 2:
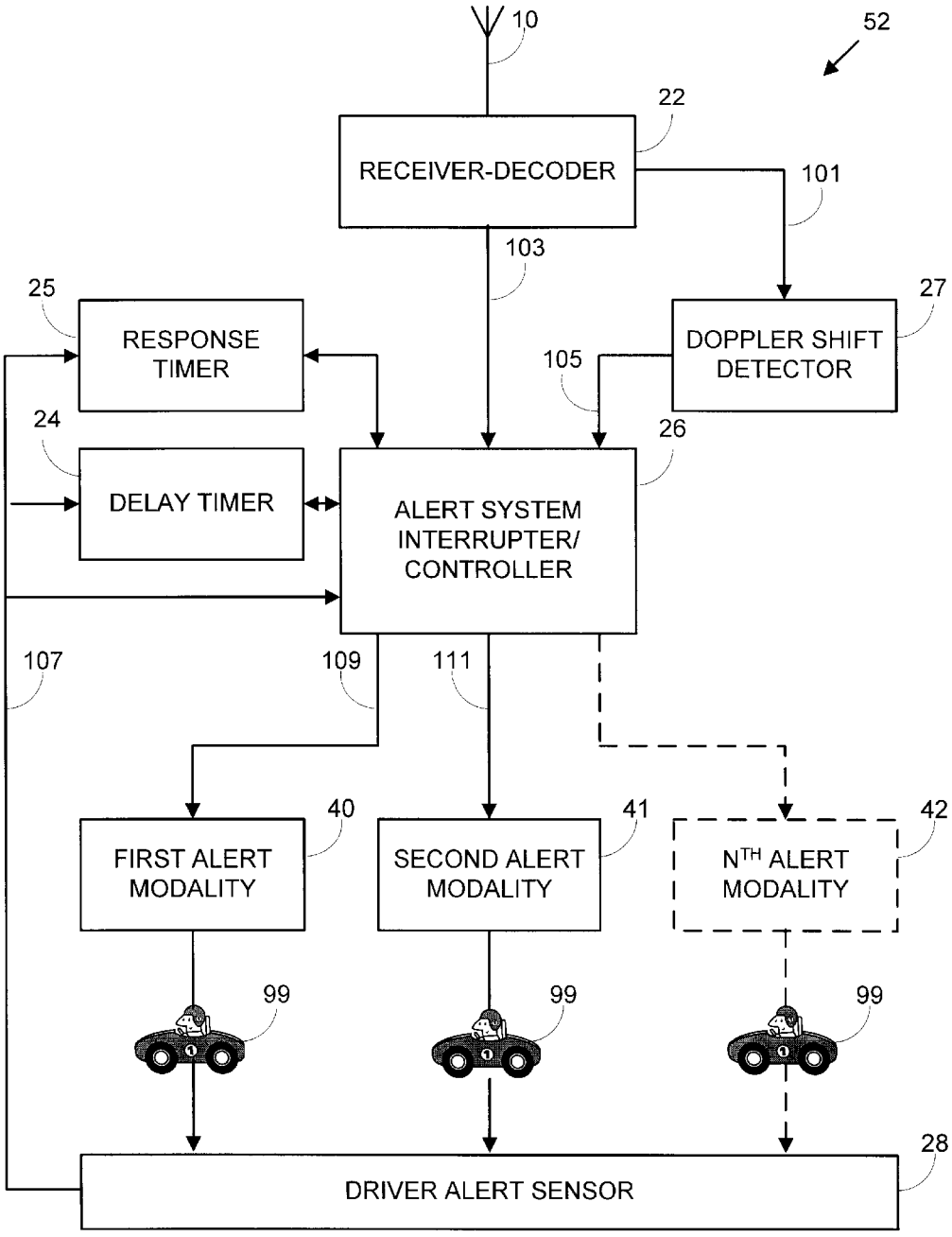
FIG. 2 schematically illustrates a modification of the receiver-decoder-alert subsystem of FIG. 1 comprising addition of a response timer to detect questionable driver responses.

The present invention relates to a vehicle warning system of relatively low cost and high utility. With widespread use as an adjunct to existing safety equipment, the system provides timely information to reduce traffic congestion and thus significantly extend the ability of police, firefighters, health care workers, and other emergency personnel to carry out their duties efficiently, even under emergency conditions. Benefits of the system are somewhat analogous to those attributed to the large electronic information signs commonly seen on modern "intelligent" highways, providing specific guidance that allows drivers to choose alternate routes and/or otherwise compensate for rapidly changing traffic conditions.

But whereas large electronic information signs are generally erected only over multi-lane highways, the warning system of the present invention also provides emergency information to individual drivers on city streets and rural roads on an as-needed, where-needed basis. The flexibility of the present invention stems in part from the mobile and localized character of the transmitting vehicle-mounted transmitters. While the path of a transmitting vehicle may be unpredictable, the capability of the warning system to reduce congestion on a right-of-way moves with the vehicle.

Preferred embodiments of the warning system of the present invention provide efficient solutions to problems inherent in earlier warning systems. They give drivers of receiving vehicles (i.e., vehicles having a receiver-decoder-alert subsystem) easily-interpreted and timely warning information related to nearby EV's and/or other transmitting vehicles (i.e., vehicles having an encoder-transmitter subsystem). There is no requirement in vehicle warning systems of the present invention for external position or direction reference systems such as those represented by GPS or by use of compasses.

Although various types of warning information are made available to a receiving vehicle driver in preferred embodiments, the relative simplicity of all embodiments of the present invention leads simultaneously to relatively low cost and high reliability. These attributes encourage widespread adoption of the invention, which tend to increase its effectiveness.

Warning information sufficient to avoid interference with an EV is preferably transmitted in a substantially horizontal plane from an omnidirectional or steerable directional antenna on each EV. Encoder-transmitter subsystems preferably transmit spread-spectrum signals (e.g., direct-sequence or frequency-hopping) and/or UWB signals which are effective even in the presence of the interference and/or multipath distortion expected in urban areas. The signals reliably reach receivers in other vehicles generally within a circle centered on the EV and having a radius about equal to the transmitter's effective range (preferably about 2500 feet in urban areas and longer in less populated areas).

Subject to licensing restrictions, the preferred effective transmitter range may be adjustable as a function of road conditions, obstacles to transmission, and transmitting vehicle speed. It may be reduced to as little as a few blocks in congested urban areas or extended to as much as a few miles on high-speed rural roads having isolated (and dangerous) intersections with feeder roads.

Encoder-transmitter subsystems of the present invention require little attention from drivers of EV's because they are preferably always in a standby mode, with transmission of an emergency warning signal occurring automatically whenever the vehicle's siren and/or flashing lights are in use. Manual turn-on is preferably provided for use when the vehicle is stopped (e.g., at a fire or crime scene).

Thus, encoder-transmitter subsystems are instantly available to provide drivers of receiving vehicles with information they can use to intelligently and safely maneuver their vehicles out of the path(s) of approaching EV's. Warning information such as the EV type (e.g., fire, police, ambulance), closing velocity and transmitter and receiver directional antenna azimuths, as provided in preferred embodiments of the present invention, reduce the incidence of false, misleading and/or distracting warnings. This makes the warnings actually provided more credible and thus more likely to be heeded.

Warnings are delivered by alerting a receiving vehicle driver to at least one of a plurality of alert modalities. Warnings may be delivered by, for example, predetermined groups of alert modalities or a predetermined sequence of individual modalities or groups of modalities, depending on the needs and preference of the driver. If a sequence of alert modalities or groups of alert modalities is presented, the sequential presentation is stopped by activation of the driver alert sensor. The presentation may also be stopped if reception of the encoded warning signal stops or, for certain alert modalities (e.g., aural modalities), if closing velocity becomes negative. Notwithstanding the stopping of a presentation however, at least one alert modality (preferably visual) remains activated to reflect the character of any encoded warning signal then being received.

The term closing velocity reflects the speed as well as direction of travel of both the transmitter and receiver. Closing velocity may be positive, as when an EV is following another vehicle but traveling at a higher rate of speed and thus closing the distance between the two vehicles. In this example, closing velocity would be negative if the EV were traveling slower than the other vehicle and thus falling further behind. More generally, closing velocity would be positive if the (straight-line) distance separating an EV from another vehicle is decreasing with time, regardless of the orientation and speed of the vehicles. Conversely, if the straight-line separation distance between an EV and another vehicle is increasing with time, closing velocity is negative.

Closing velocity may be estimated from a time sequence of separation distance values calculated from a corresponding time sequence of positions of an EV and another vehicle. As noted above, such vehicle position information has in the past been obtained relative to local landmarks and/or relative to a coordinate system such as that provided by GPS signals. But in preferred embodiments of the warning system of the present invention, closing velocity may be estimated from changes in signal transmission time or from doppler shifts (detected at receivers) in encoded warning signals. Signal transmission time changes may be derived from a series of sequential signals, each bearing an encoded transmission time. There is no requirement for a synchronized time base in transmitters or receivers. Doppler shift based estimation from spread-spectrum signals is described in numerous patents such as, for example, the '599, '997, '257, and '311, patents incorporated by reference above.

Transmitter frequencies for warning systems of the present invention are preferably in the microwave or millimeter wave range. To increase the likelihood of reliable reception of these transmissions by drivers of other vehicles, a plurality of predetermined transmitter frequencies may be used in certain frequency-hopping embodiments, the frequencies being accurately determined and encoded prior to transmission to allow decoding at the receiver. Subsequent comparison of actual received frequencies with decoded values for transmitted frequencies from a given EV allows calculation of Doppler frequency shifts for estimating closing velocity for the given vehicle.

In certain embodiments of the warning system, a transmitting vehicle uses a single known carrier frequency to activate receivers tuned to that frequency in any receiving vehicle within the transmitter's range. A receiver operating under these conditions is relatively more susceptible to interference than it would be if a variety of frequencies (i.e., spread-spectrum and/or UWB) were used. For this reason, the preferred embodiments of receiver-decoder-alert subsystems 50, 52, 54, 56 and 58 schematically illustrated in FIGS. 1–5 respectively all incorporate a spread-spectrum and/or UWB receiver-decoder 22. Each receiver-decoder-alert subsystem is designed for alerting a driver of a receiving vehicle carrying the subsystem to warning information carried by an encoded warning signal that was transmitted by an encoder-transmitter subsystem carried by a transmitting vehicle.

In each illustrated embodiment, receiver-decoder 22 provides an output 103 (the decoded warning signal) and an output 101 (the received encoded warning signal). Each output 101 and 103 comprises the same ID code as that in the warning signal reaching receiver-decoder 22 through omnidirectional antenna 10 or directional antenna 12. Received encoded warning signal 101 is directed to Doppler shift detector 27 to produce a closing velocity signal 105 that is a function of Doppler shift in signal 101. Note that Doppler shift will, in general, occur in signal 101 during relative motion between the transmitting and receiving vehicle. The magnitude and sign of the Doppler shift are directly related to closing velocity and may be estimated by several well-known methods, examples of which are described in references cited herein.

Alternatively, closing velocity 105 may be estimated by changes in signal transmission time from transmitting to receiving vehicle. These transmission time changes, in turn, may be estimated by observing time periods between packet transmissions that are encoded in the packets as they are transmitted. These encoded time periods may be compared with corresponding measured time periods separating the packets arrival at a receiver-decoder. Positive closing velocity 105 is associated with measured time periods that are shorter than the respective encoded time periods, and negative closing velocity 105 is associated with measured time periods that are longer than the respective encoded time periods.

Closing velocity 105 and decoded warning signal 103 are both presented to alert system interrupter/controller 26 to produce at least first and second alert modality activating signals 109 and 111 respectively, which are applied to at least first and second alert modalities 40 and 41 respectively. As indicated in FIGS. 1–5, additional alert modalities may be used in the receiver-decoder-alert subsystem of the present invention.

The vehicle warning system of the present invention comprises at least first and second alert modalities 40 and 41 respectively (preferably comprising aural and visual alert modalities respectively) for presentation of emergency information. Visual modalities include, but are not limited to, heads-up displays, cathode ray tubes, liquid crystal displays, and/or lamps or lamp arrays (comprising, for example, light-emitting-diodes, gas discharge tubes, and/or incandescent bulbs). Aural modalities include, but are not limited to, electromechanical or electrostatic speakers, piezoelectric alarms, vibrating alarms, bells, whistles or voice warning messages. The present invention relates in part to techniques for use of these and other modalities to alert a driver regarding available warning information, while minimizing any adverse effects on safe vehicular operation. Intermittent delay of one or more alerts by means of a timer 24, as one such technique, is a preferred way to reduce a driver's cognitive burden and hence encourage safe vehicle operation.

Activation of any such a warning delay timer 24 in receiver-decoder-alert subsystems of the present invention requires acknowledgment by a receiving vehicle driver 99 through a driver alert sensor 28 that emergency information has been received. As indicated in FIGS. 1–5, activation of driver alert sensor 28 produces an alert sensor signal 107 that indicates acknowledgement by the driver of activation of at least one alert modality. Alert sensor signal 107 is presented to delay timer 24. Delay timer 24 then acts on alert system interrupter/controller 26 to delay application of at least first alert modality activating signal 109 to first alert modality 40 for a delay period after the driver's acknowledgement.

The delay imposed by delay timer 24 may be for a predetermined or variable period. On initial presentation of warning information, the delay period is zero, meaning one or more alert modalities are presented to a driver without significant delay. To temporarily turn off any alert modality, a driver activates driver alert sensor 28, thereby providing an alert sensor signal 107 to delay timer 24. Alert sensor signal 107 thus simultaneously acknowledges the warning and eliminates the distraction caused by the alert modality itself. Alert modalities that are intermittently (i.e., temporarily) deactivated through the action of delay timer 24 are reactivated when there is new information to be presented to the driver. But such temporary deactivation is extended indefinitely when an encoded warning signal is no longer being received and decoded in a receiving vehicle. Deactivation is generally terminated when an encoded warning signal is again received.

Figure 3:
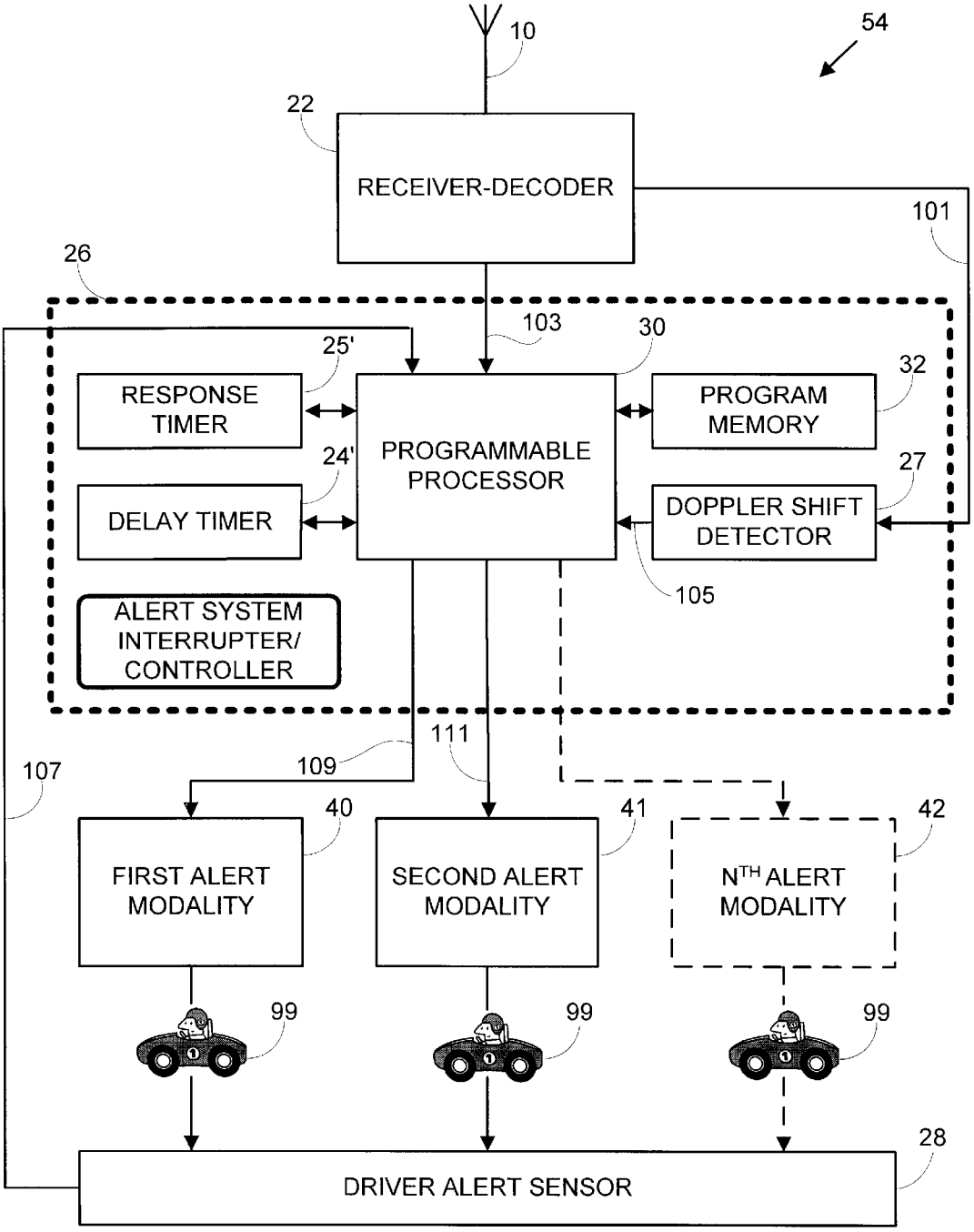
FIG. 3 schematically illustrates a preferred embodiment of the receiver-decoder-alert subsystem of FIG. 2 comprising a programmable processor to digitally simulate the functions of a delay timer, a response timer and an alert system interrupter/controller.
Figure 4:
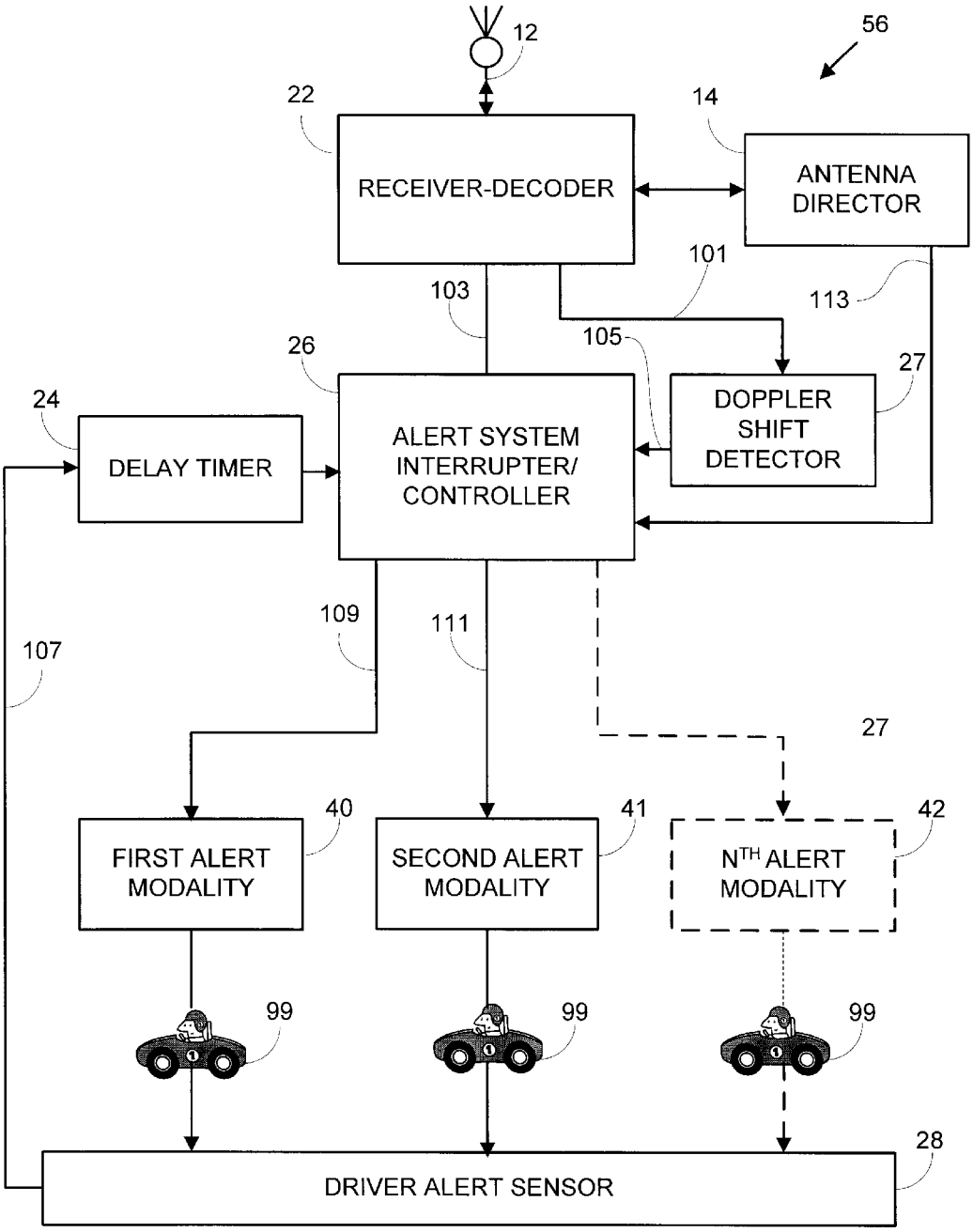
FIG. 4 schematically illustrates a modification of the receiver-decoder-alert subsystem of FIG. 1 comprising replacement of an omnidirectional antenna with a steerable directional antenna and addition of an antenna director.
Figure 5:
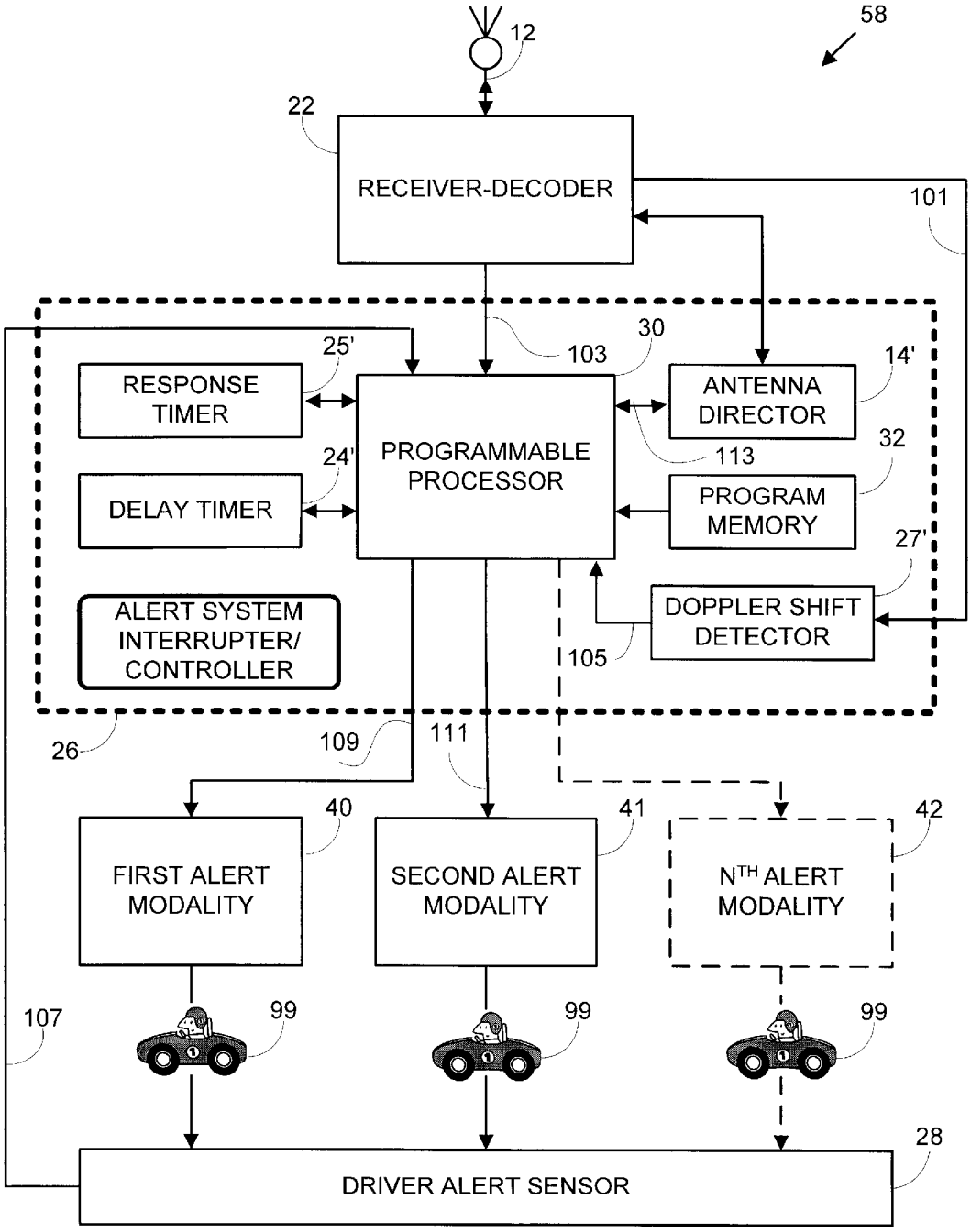
FIG. 5 schematically illustrates a modification of the receiver-decoder-alert subsystem of FIG. 3 comprising replacement of an omnidirectional antenna with a steerable directional antenna and addition of an antenna director.

Delay periods between intermittent alerts may be of a predetermined length, such as that provided by a time-delay relay. Or, in certain preferred embodiments, delay periods may be variable (e.g., a function of a driver's response time to a previous alert). For example, the delay period may be inversely proportional to response time as measured by a response timer 25. Response timer 25 is connected to alert system interrupter/controller 26 and alert sensor signal 107 to detect the time between activation of at least one alert modality 40, 41 or 42 and the driver's acknowledgment of the alert via alert sensor 28 and alert sensor signal 107. Calculation of variable delay periods is facilitated in preferred embodiments through use of a digitally simulated delay timer 24' and response timer 25'. As schematically illustrated in FIGS. 3 and 5, the respective timing functions are simulated by a programmable processor 30 having program memory 32.

As noted above, any delay in presentation of warning information is terminated if an additional type of warning information is received simultaneously (e.g., warnings transmitted from two separate fire trucks approaching the same intersection). To help ensure that all encoded warning signals reaching a receiving antenna are properly decoded, preferred embodiments of the present invention comprise encoding means in the transmitter(s) and corresponding decoding means in the receivers that provide for multiple access.

As an alternative to the encoding means referenced above, an encoder-transmitter subsystem may comprise, for example, a flexible and secure system that uses random burst transmission of digital packets of emergency information, with various types of warning information securely encoded in each packet. Where several embodiments of the vehicle warning system of the current invention may be found in the same area (e.g., a large city), each type of encoded warning information preferably has its own decoder. In this way, even relatively basic embodiments of the system will function by providing drivers with transmitter ID and closing velocity information. Portions of a received warning signal comprising encoded information will simply be ignored by receivers not having the corresponding decoders. This allows simultaneous use of portions of the electromagnetic spectrum for different purposes.

During random burst transmission, each digitally encoded packet is transmitted on a bandwidth substantially greater than the minimum otherwise required, with the received frequencies differing slightly due to any Doppler shift that may be present. Each decoded packet is associated with its own Doppler shift and any directional information obtained from the antenna director 14 for the receiver directional antenna 12 simultaneous with reception of that packet. Antenna director 14 is connected to receiver-decoder 22 for steering directional antenna 12 to an azimuth at which received encoded warning signal 101 is maximized, and for producing an azimuth signal 113 corresponding to the signal maximum. In each of several preferred embodiments of the invention (see, for example, FIGS. 4 and 5), azimuth signal 113 is provided to alert system interrupter/controller 26 for representation in one or more alert modalities as, for example, a colored line extending from a graphic representation of the receiving vehicle. Note that in the subsystem of FIG. 5, azimuth signal 113 is produced by digitally simulated antenna director 14', the simulation being implemented by programmable processor 30 and program memory 32.

Since substantial information can be encoded in each packet, a packet transmission system for warning information is particularly useful in providing reliable means for each receiver-decoder-alert subsystem to verify the authenticity of any warning information received. Further, encoding and decoding protocols may themselves be updated through remote programming of processor 30 and program memory 32.

Figure 6A:
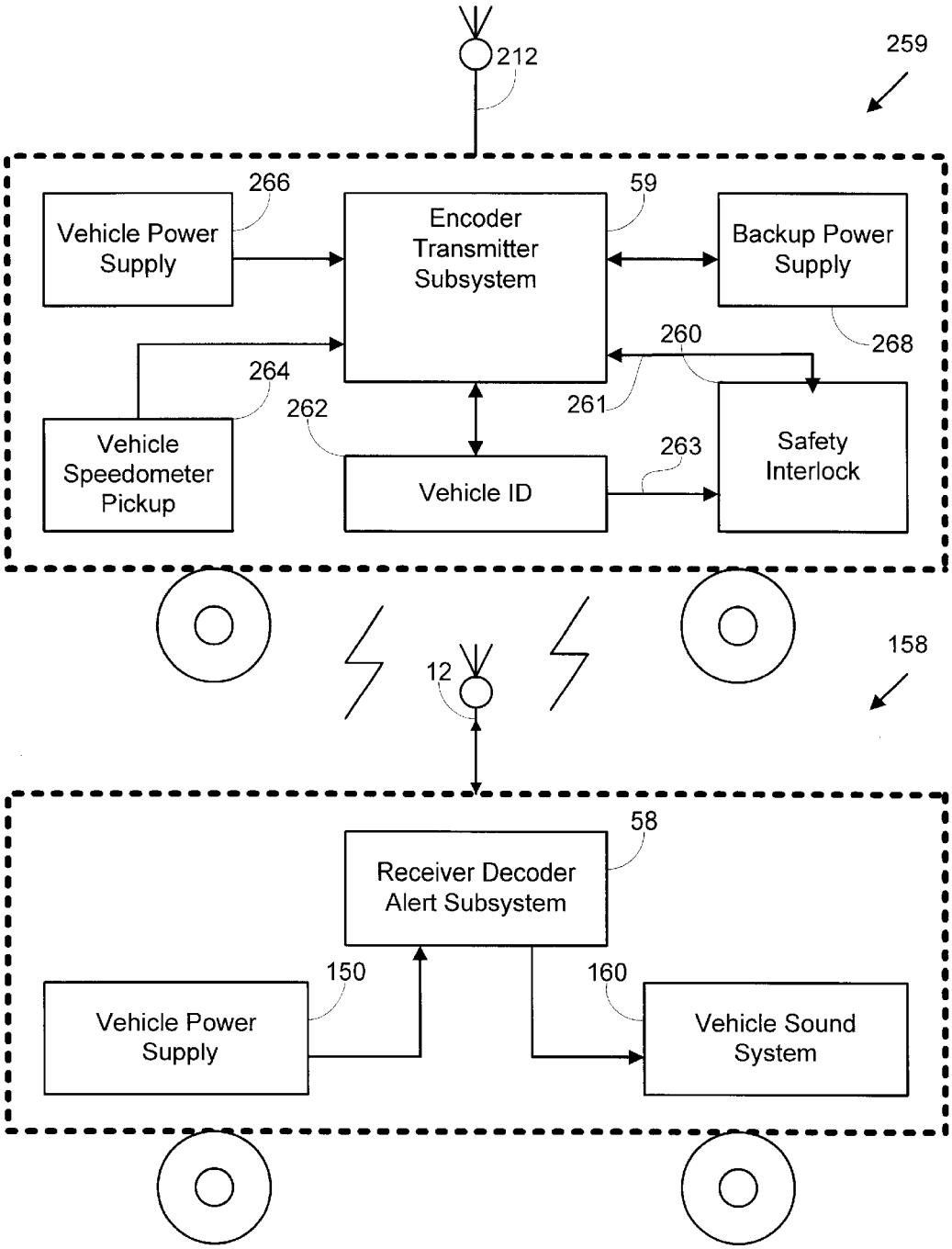
FIG. 6A schematically illustrates preferred embodiments of an encoder-transmitter subsystem in a transmitting vehicle and a receiver-decoder-alert subsystem in a receiving vehicle.

Preferred embodiments of an encoder-transmitter subsystem 59 in a transmitting vehicle 259 and a receiver-decoder-alert subsystem 58 in a receiving vehicle 158 are schematically illustrated in FIG. 6A. In receiving vehicle 158, receiver-decoder-alert subsystem 58 draws electrical power as needed from the vehicle power supply 150 and can send an aural alert modality activating signal to vehicle sound system 160.

In transmitting vehicle 259, the encoder-transmitter subsystem 59 draws electrical power as needed from the vehicle power supply 266, but can also draw electrical power from backup power supply 268 for a predetermined time in case the vehicle power supply 266 fails. Because function of the encoder-transmitter is safety-related, the transmitter is preferably in a standby mode whenever it is not transmitting. Use of a standby mode, preferably with a backup power supply, may also be included in preferred embodiments of receiver-decoder-alert subsystem 58 for similar reasons.

In the standby mode, the transmitter (or receiver as the case may be) "sleeps" for a short period of time and then, as part of an automatic cycle, "awakens" to determine if a transmission (or reception) is required. If no transmission (or reception) is required, the transmitter (or receiver) "sleeps" again for a short period to begin another cycle. This standby cycle conserves electrical power and may also support ongoing maintenance activities, such as periodic self-tests, with automatic reporting of any problems diagnosed.

The speed of transmitting vehicle 259 is obtained from vehicle speedometer pickup 264 and presented to encoder-transmitter subsystem 59 for encoding for packet transmission via directional antenna 212. Similarly, a unique vehicle ID number 262 (preferably, e.g., the VIN or manufacturer's vehicle identification number) is obtained (preferably from the vehicle's engine electronic control unit) and presented to encoder-transmitter subsystem 59 for encoding and transmission. Vehicle ID signal 263 is also presented to safety interlock 260 to aid in blocking unauthorized use of encoder-transmitter subsystem 59.

Figure 6B:
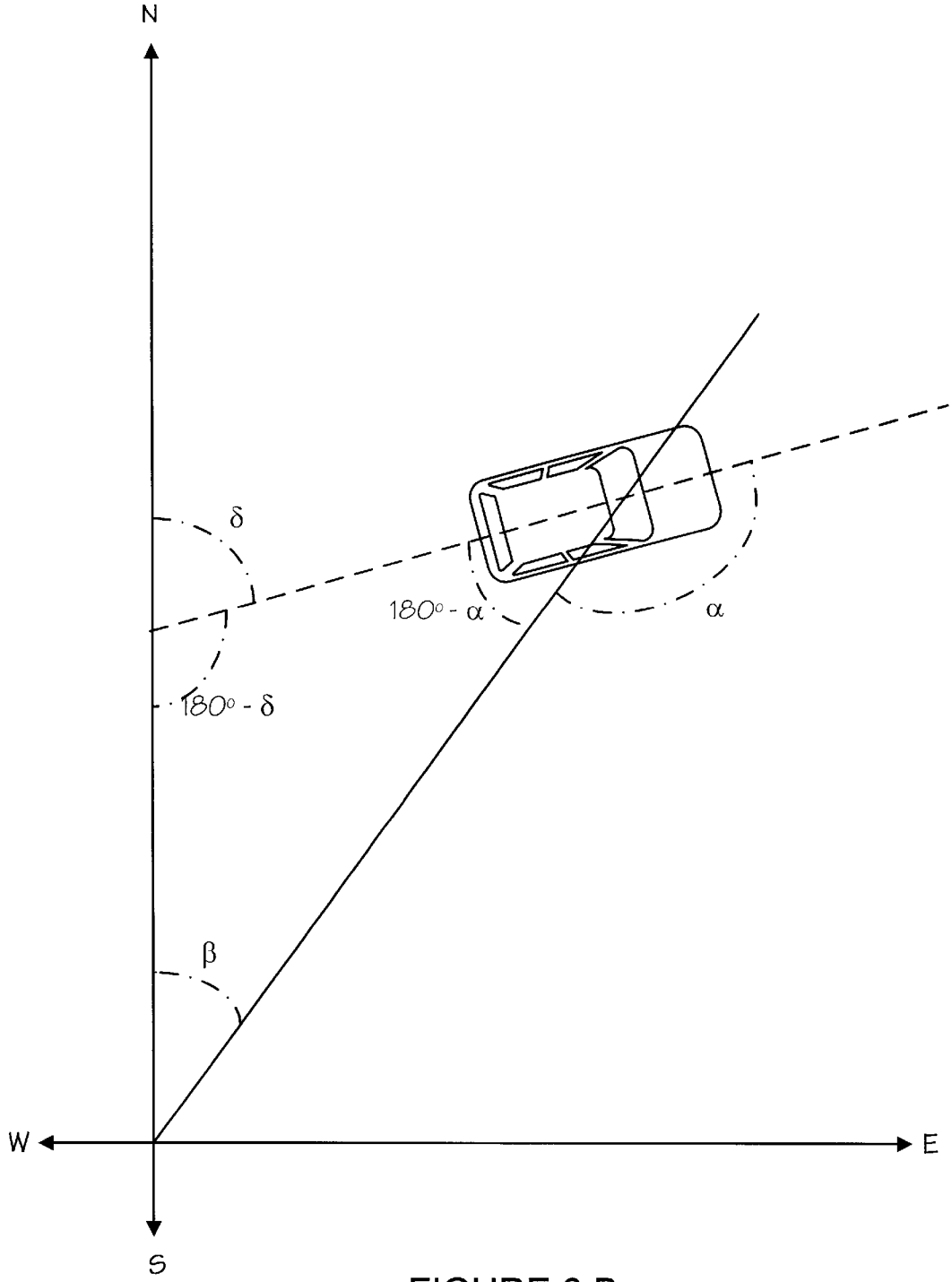
FIG. 6B schematically illustrates angular relationships between transmitting and receiving antenna azimuth references.

Other useful warning information comprises the azimuth of directional antenna 212, which may be combined with the azimuth of directional antenna 12 (both of these antenna azimuths being readily be referenced to, for example, the direction of forward travel of the respective vehicle), to estimate vehicle heading. Heading estimates made at one or more vehicles for a particular vehicle may, in turn, may be used to facilitate warnings and/or vehicle avoidance. Parameters useful in making heading estimates are schematically illustrated in FIG. 6B, wherein heading angle $\delta$ may be estimated by subtracting transponder antenna azimuth $\alpha$ from the sum of antenna azimuth $\beta$ and 180 degrees. Similar heading information is available at any vehicle receiving such azimuth information.

Note that speeds of first and second vehicles (obtained, for example, by direct indications from the respective speedometers) may be combined with headings of these vehicles to yield an estimate of the closing velocity of the two vehicles.

First and second vehicle headings may be estimated relative to the respective azimuths of the directional antennas facilitating communication between the vehicles, and/or headings may be estimated relative to an external reference such as true north. This information may be used directly to calculate the component of each vehicle's closing velocity (i.e., the component of its speed and direction that is directed toward or away from the other vehicle). The algebraic sum of these closing velocity components (i.e., the net closing velocity) may then be compared, for example, with a closing velocity estimated from Doppler shift in communication signals passing between the vehicles. This example illustrates how the present invention can provide redundant information to increase operational flexibility and reliability under marginal operating conditions brought on by, for example, inclement weather and/or electrical interference.

U.S. Patents useful in understanding the operational flexibility of the present invention include U.S. Pat. Nos. 4,818,998; 4,903,279; 4,908,629; 6,191,708; 6,292,724; 6,320,514; 6,320,535; 6,323,566; 6,329,901; 6,330,452; 6,331,825; 6,346,877; and 6,353,743, each patent incorporated herein by reference.

Further redundancy may be obtained, for example, through the addition of specialized receivers for time standard signals to transmitters of the present invention. Time standard signals, such as those broadcast by WWV and/or by appropriately placed repeaters, may be used to synchronize clocks connected to transmitters and/or receivers to facilitate distance and/or velocity estimates.

Figure 7:
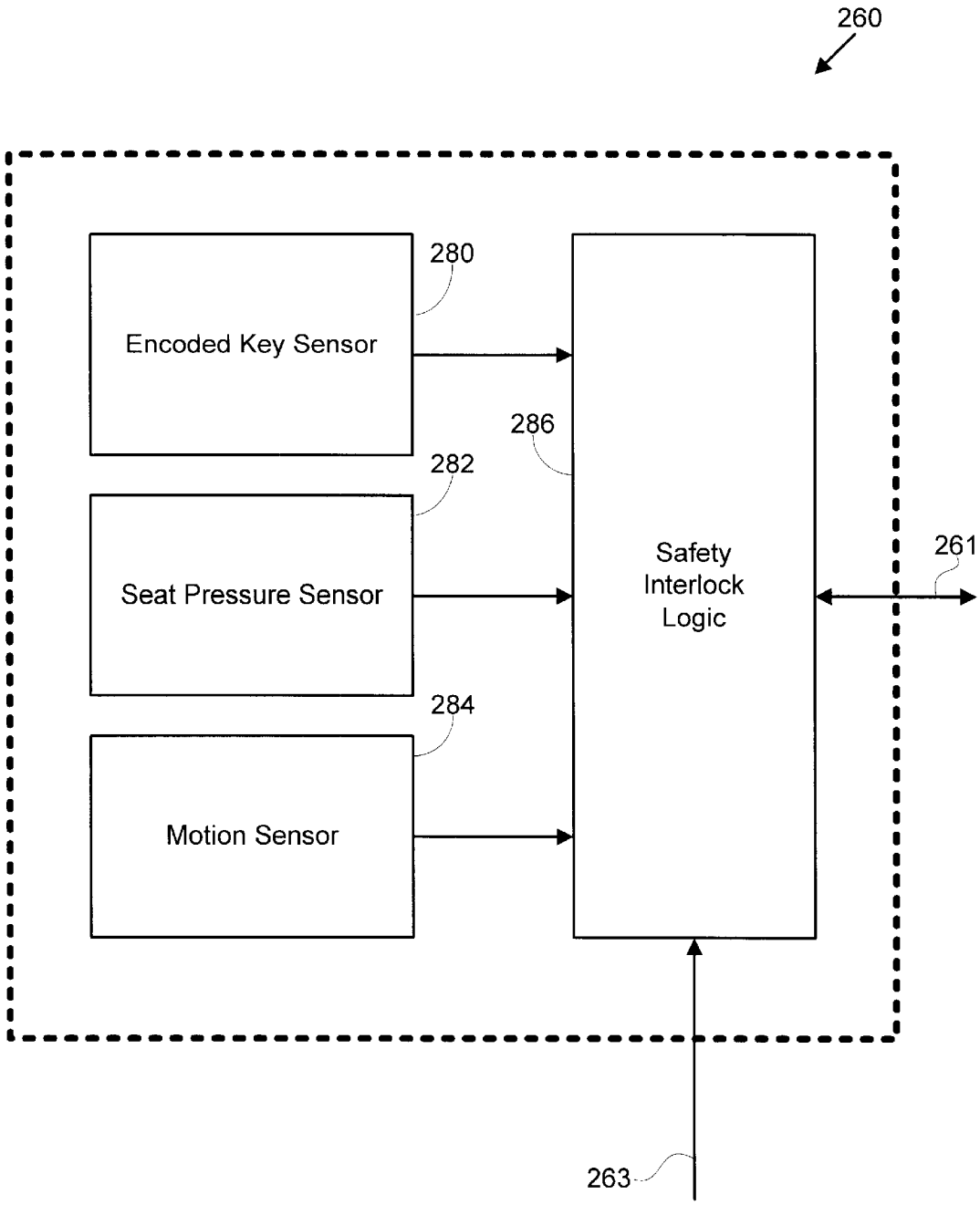
FIG. 7 schematically illustrates a preferred embodiment of the safety interlock shown in the transmitting vehicle of FIG. 6A.

Such estimates may be made by encoding the time of a signal's transmission in the signal as it is transmitted, and then noting the difference between the time of signal transmission and the time when the signal is received and decoded at a distant point. If a single time standard is economically available at both transmitter and receiver, then the time difference (i.e., the elapsed time for signal travel) can be multiplied by the estimated signal velocity to obtain an estimate of the distance separating the transmitter from the receiver. Serial estimates of these separation distances at known time intervals may be used to estimate closing velocity between the transmitter and receiver. These distance and closing velocity estimates may be used independently or compared with analogous estimates obtained by other means as described herein to yield a higher level of confidence in the estimates. Preferred embodiments of the invention may employ one or more such redundancies to improve reliability through skillful application of information derivable from use of the invention. Another example of the use of redundant information may be seen in a preferred application of the encoder-transmitter subsystem 59. As schematically illustrated in FIG. 7, safety interlock 260 preferably comprises a plurality of sensors 280, 282 and 284 which connect through safety interlock logic 286 with vehicle ID signal 263 to assure that only authorized use is made of encoder-transmitter subsystem 59. In the illustrated example structure of safety interlock 260 in FIG. 7, an encoded key sensor 280 is connected through safety interlock logic 286 with vehicle ID signal 263 to provide encoded transmitter activating signal 261.

When a properly encoded key (not shown) is read by encoded key sensor 280, this reading is compared with ID signal 263 (as, for example, via a programmable processor in safety interlock logic 286) to produce encoded transmitter activating signal 261. Thus, during authorized use of encoder-transmitter subsystem 59, the key code read by encoded key sensor 280 is verified via safety interlock logic 286 as corresponding to vehicle ID signal 263. If the key code does not correspond to vehicle ID signal 263, transmitter activating signal 261 is not provided. Further, encoder-transmitter subsystem 59 may either be rendered unusable or, alternatively, may be made to transmit an error signal indicating the absence of a properly encoded key (or the presence of an unauthorized driver as during theft of an EV).

In the illustrated example, the presence of a driver in transmitting vehicle 260 (sensed by seat pressure sensor 282 and/or intra-vehicle motion sensor 284) without a proper sensed key code corresponding to the vehicle ID signal will cause transmission of the error signal described above. Further, if encoder-transmitter subsystem 59 is removed from transmitting vehicle 259 and installed in a second vehicle, it may be disabled (or caused to transmit an error signal) unless provided with the predetermined encoded transmitter activating signal 261 corresponding to the ID code of the second vehicle.

Note that safety interlock 260 may employ a variety of sensors other than those in the above example to ensure encoder-transmitter subsystem 59 only transmits proper warning signals when the driver of transmitting vehicle 259 is authorized (as evidenced in this example by use of a properly encoded key).

What is claimed is:

1. A receiver-decoder-alert subsystem for alerting a driver of a receiving vehicle carrying the subsystem to warning information carried by an encoded warning signal, the subsystem comprising a receiver-decoder for receiving and decoding said encoded warning signal to produce a decoded warning signal, said receiver-decoder comprising an antenna;

closing velocity estimating means connected to said receiver-decoder for producing a closing velocity signal;

at least first and second alert modalities for representing, when activated, warning information in said decoded warning signal and said closing velocity signal to said vehicle driver;

an alert system interrupter/controller connected to said decoded warning signal and said closing velocity signal to produce at least first and second alert modality activating signals for activating said at least first and second alert modalities respectively;

a driver alert sensor, activation of which produces an alert sensor signal that indicates acknowledgement by said vehicle driver of activation of at least one alert modality; and a delay timer connected to said alert sensor signal and said alert system interrupter/controller for delaying application of at least said first alert modality activating signal to said first alert modality for a delay period after said alert sensor signal indicates a driver's acknowledgement of at least one alert modality.

2. The receiver-decoder-alert subsystem of claim 1 wherein said first alert modality represents information in said closing velocity signal aurally.

3. The receiver-decoder-alert subsystem of claim 2 wherein said aural representation comprises a periodic signal having an audible characteristic that is a function of said closing velocity signal.

4. The receiver-decoder-alert subsystem of claim 3 wherein said audible characteristic comprises volume.

5. The receiver-decoder-alert subsystem of claim 1 wherein said second alert modality represents information in said decoded warning signal visually.

6. The receiver-decoder-alert subsystem of claim 5 wherein said visual representation comprises a visible icon shape corresponding to vehicle identity information in said decoded warning signal.

7. The receiver-decoder-alert subsystem of claim 5 wherein said visual representation comprises a visible icon color corresponding to vehicle identity information in said decoded warning signal.

8. The receiver-decoder-alert subsystem of claim 1 additionally comprising a third alert modality, wherein said third alert modality represents information in said decoded warning signal tactilely.

9. A receiver-decoder-alert subsystem for alerting a driver of a receiving vehicle carrying the subsystem to warning information carried by an encoded warning signal, the subsysten comprising a receiver-decoder for receiving and decoding said encoded warning signal to produce a decoded warning signal, said receiver-decoder comprising an antenna;

a doppler shift detector connected to said received-encoded warning signal to produce a closing velocity signal, said closing velocity signal being a function of doppler shift in said received encoded warning signal;

at least first and second alert modalities for representing, when activated, warning information in said decoded warning signal and said closing velocity signal to said vehicle driver;

an alert system interrupter/controller connected to said decoded warning signal and said closing velocity signal to produce at least first and second alert modality activating signals for activating said at least first and second alert modalities respectively;

a driver alert sensor, activation of which produces an alert sensor signal that indicates acknowledgement by said vehicle driver of activation of at least one alert modality;

a response timer connected to said alert sensor signal and said alert system interrupter/controller for measuring a time period between activation of at least one said alert modality by said alert system interrupter/controller and activation of said driver alert sensor; and a delay timer connected to said alert sensor signal and said alert system interrupter/controller for delaying application of at least said first alert modality activating signal to said first alert modality for a delay period after said alert sensor signal indicates a driver's acknowledgement of at least one alert modality.

10. The receiver-decoder-alert subsystem of claim 9 wherein said first alert modality represents information in said closing velocity signal aurally.

11. The receiver-decoder-alert subsystem of claim 10 wherein said aural representation comprises a periodic signal having an audible characteristic that is a function of said closing velocity signal.

12. The receiver-decoder-alert subsystem of claim 11 wherein said audible characteristic comprises volume.

13. The receiver-decoder-alert subsystem of claim 9 wherein said second alert modality represents information in said decoded warning signal visually.

14. The receiver-decoder-alert subsystem of claim 13 wherein said visual representation comprises a visible icon shape corresponding to vehicle identity information in said decoded warning signal.

15. The receiver-decoder-alert subsystem of claim 13 wherein said visual representation comprises a visible icon color corresponding to vehicle identity information in said decoded warning signal.

16. The receiver-decoder-alert subsystem of claim 9 additionally comprising a third alert modality, wherein said third alert modality represents information in said decoded warning signal tactilely.

17. A receiver-decoder-alert subsystem for alerting a driver of a receiving vehicle carrying the subsystem to warning information carried by an encoded warning signal, the subsystem-comprising a receiver-decoder for receiving and decoding said encoded warning signal to produce a decoded warning signal, said receiver-decoder comprising a steerable directional antenna;

an antenna director connected to said receiver-decoder for steering said directional antenna to an azimuth at which said received encoded warning signal is maximized, and for producing an azimuth signal corresponding said signal maximum;

a doppler shift detector connected to said received-encoded warning signal to produce a closing velocity signal, said closing velocity signal being a function of doppler shift in said received encoded warning signal;

at least first and second alert modalities for representing, when activated, warning information in said decoded warning signal and said closing velocity signal to said vehicle driver;

an alert system interrupter/controller connected to said decoded warning signal, said azimuth signal and said closing velocity signal to produce at least first and second alert modality activating signals for activating said at least first and second alert modalities respectively;

a driver alert sensor, activation of which produces an alert sensor signal that indicates acknowledgement by said vehicle driver of activation of at least one alert modality;

a response timer connected to said alert sensor signal and said alert system interrupter/controller for measuring a time period between activation of at least one said alert modality by said alert system interrupter/controller and activation of said driver alert sensor; and a delay timer connected to said alert sensor signal and said alert system interrupter/controller for delaying application of at least said first alert modality activating signal to said first alert modality for a delay period after said alert sensor signal indicates a driver's acknowledgement of at least one alert modality.

18. The receiver-decoder-alert subsystem of claim 17 wherein said first alert modality represents information in said closing velocity signal aurally.

19. The receiver-decoder-alert subsystem of claim 18 wherein said aural representation comprises a periodic signal having an audible characteristic that is a function of said closing velocity signal.

20. The receiver-decoder-alert subsystem of claim 19 wherein said audible characteristic comprises volume.

* * * * *